US009851107B2

(12) United States Patent
Stuttaford et al.

(10) Patent No.: US 9,851,107 B2
(45) Date of Patent: Dec. 26, 2017

(54) AXIALLY STAGED GAS TURBINE COMBUSTOR WITH INTERSTAGE PREMIXER

(71) Applicant: ANSALDO ENERGIA IP UK LIMITED, London (GB)

(72) Inventors: Peter John Stuttaford, Jupiter, FL (US); Paul Economo, Jupiter, FL (US); Stephen Jorgensen, Palm City, FL (US); Donald Gauthier, Jupiter, FL (US); Timothy Hui, Palm Beach Gardens, FL (US)

(73) Assignee: ANSALDO ENERGIA IP UK LIMITED (GB)

( * ) Notice: Subject to any disclaimer, the term of this patent is extended or adjusted under 35 U.S.C. 154(b) by 402 days.

(21) Appl. No.: 14/334,918

(22) Filed: Jul. 18, 2014

(65) Prior Publication Data

US 2016/0018110 A1 Jan. 21, 2016

(51) Int. Cl.

| | |
|---|---|
| ***F23R 3/00*** | (2006.01) |
| ***F23R 3/28*** | (2006.01) |
| ***F23R 3/34*** | (2006.01) |
| *F23R 3/06* | (2006.01) |

(52) U.S. Cl.

CPC ..... *F23R 3/286* (2013.01); *F23R 3/002* (2013.01); *F23R 3/346* (2013.01); *F23R 3/06* (2013.01)

(58) Field of Classification Search

CPC ..... F23R 3/286; F23R 3/002; F23R 3/346; F23R 3/06

USPC ..... 60/776

See application file for complete search history.

(56) References Cited

U.S. PATENT DOCUMENTS

| | | | | |
|---|---|---|---|---|
| 4,288,980 | A * | 9/1981 | Ernst | F23R 3/002 60/39.23 |
| 4,308,718 | A * | 1/1982 | Mowill | F01D 25/30 415/207 |
| 4,431,374 | A * | 2/1984 | Benstein | F04D 29/444 415/169.1 |
| 4,796,429 | A * | 1/1989 | Verdouw | F23R 3/04 60/751 |
| 5,839,283 | A * | 11/1998 | Dobbeling | F23R 3/045 60/737 |
| 6,047,550 | A * | 4/2000 | Beebe | F23L 7/00 60/733 |
| 6,192,688 | B1 * | 2/2001 | Beebe | F23L 7/00 60/723 |
| 6,334,297 | B1 * | 1/2002 | Dailey | F23R 3/04 60/751 |
| 6,868,676 | B1 * | 3/2005 | Haynes | F02C 3/14 60/740 |

(Continued)

*Primary Examiner* — Peter Helvey

(74) *Attorney, Agent, or Firm* — Hovey Williams LLP; Peter C. Knops

(57) ABSTRACT

The present invention discloses a novel and improved apparatus and method for reducing the emissions of a gas turbine combustion system. More specifically, a combustion system is provided having a first combustion chamber and a premixer positioned proximate an outlet end of a combustion liner for mixing a second fuel/air mixture with hot combustion gases and burning the subsequent mixture to achieve reduced emissions levels. The premixer is positioned generally about the combustion liner and includes a plurality of channels and fuel injectors for introducing a fuel/air mixture, induced with a swirl, into a second, axially staged combustor.

14 Claims, 10 Drawing Sheets

(56) References Cited

U.S. PATENT DOCUMENTS

| | | | | |
|---|---|---|---|---|
| 6,931,854 | B2 * | 8/2005 | Saitoh | F23R 3/286 60/737 |
| 2007/0068165 | A1 * | 3/2007 | Tiemann | F01D 25/12 60/751 |

* cited by examiner

AXIALLY STAGED GAS TURBINE COMBUSTOR WITH INTERSTAGE PREMIXER

CROSS-REFERENCE TO RELATED APPLICATIONS

Not applicable.

TECHNICAL FIELD

The present invention generally relates to an apparatus and method for enhancing combustion efficiency, increasing turndown and reducing nitrous oxide (NOx) and carbon monoxide (CO) emissions through axially staged combustion. More specifically, the present invention is directed towards a gas turbine combustion liner and way of injecting fuel and air into a combustion liner after a first stage of combustion has occurred.

BACKGROUND OF THE INVENTION

In a typical gas turbine engine, a compressor having alternating stages of rotating and stationary airfoils is coupled to a turbine, which also has alternating stages of rotating and stationary airfoils. The compressor stages decrease in size, and as the volume decreases, the air passing therethrough is compressed, raising its temperature and pressure. The compressed air is then supplied to one or more combustors which mixes the air with fuel and ignites the mixture to form hot combustion gases. The hot combustion gases are directed into a turbine, where the expansion of the hot combustion gases drives the stages of a turbine, which is in turn, coupled to the compressor to drive the compressor. The exhaust gases can then be used as a source of propulsion, as typical in an aircraft engine, or in powerplant operations to turn a shaft coupled to a generator for producing electricity.

The exact type and size of combustion systems used in a gas turbine engine can vary depending on a variety of factors such as engine geometry, performance requirements, and fuel type. Each combustor typically includes at least one fuel injection means and ignition source. The gas turbine engine may have a single combustor or a series of individual or inter-connected combustors.

Combustion systems however do not always burn all of the fuel particles or do not completely burn the fuel particles, which results in higher emissions. Therefore, what is needed is a way of more completely mixing and burning the fuel particles to obtain the maximum energy output from the burned fuel while minimizing the resulting emissions.

SUMMARY

In accordance with the present invention, there is provided a novel and improved method and apparatus for an axially staged combustion system. The combustion system comprises a combustion liner having a first combustion chamber, a transition duct in communication with the combustion liner and a premixer positioned generally axially between the combustion liner and the transition duct. The premixer comprises a plurality of channels and a plurality of fuel injectors positioned proximate the channels for injecting fuel into the channels to mix with a passing air flow.

In an alternate embodiment, a premixer for injecting a fuel/air mixture into a combustor downstream of a first combustion chamber is disclosed. The premixer comprises a plurality of vanes oriented in both a tangential and axial direction, forming channels therebetween, and a plurality of fuel injectors positioned proximate the channels such that fuel and air pass through the channels positioned radially outward of the combustion liner, is imparted with a swirl, mix and is directed radially inward proximate an outlet end of the combustion liner.

In yet another embodiment of the present invention, a method of providing low emission operation for a gas turbine combustor is disclosed. The method comprises providing a flow of fuel and air to form a first fuel/air mixture and burning the first fuel/air mixture within the first combustion chamber. The method also includes providing a flow of fuel and air through a premixer to generate a second fuel/air mixture proximate an inlet region of a transition duct, where the second fuel/air mixture is mixed and auto-ignited with the hot combustion gases from the first combustion chamber.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
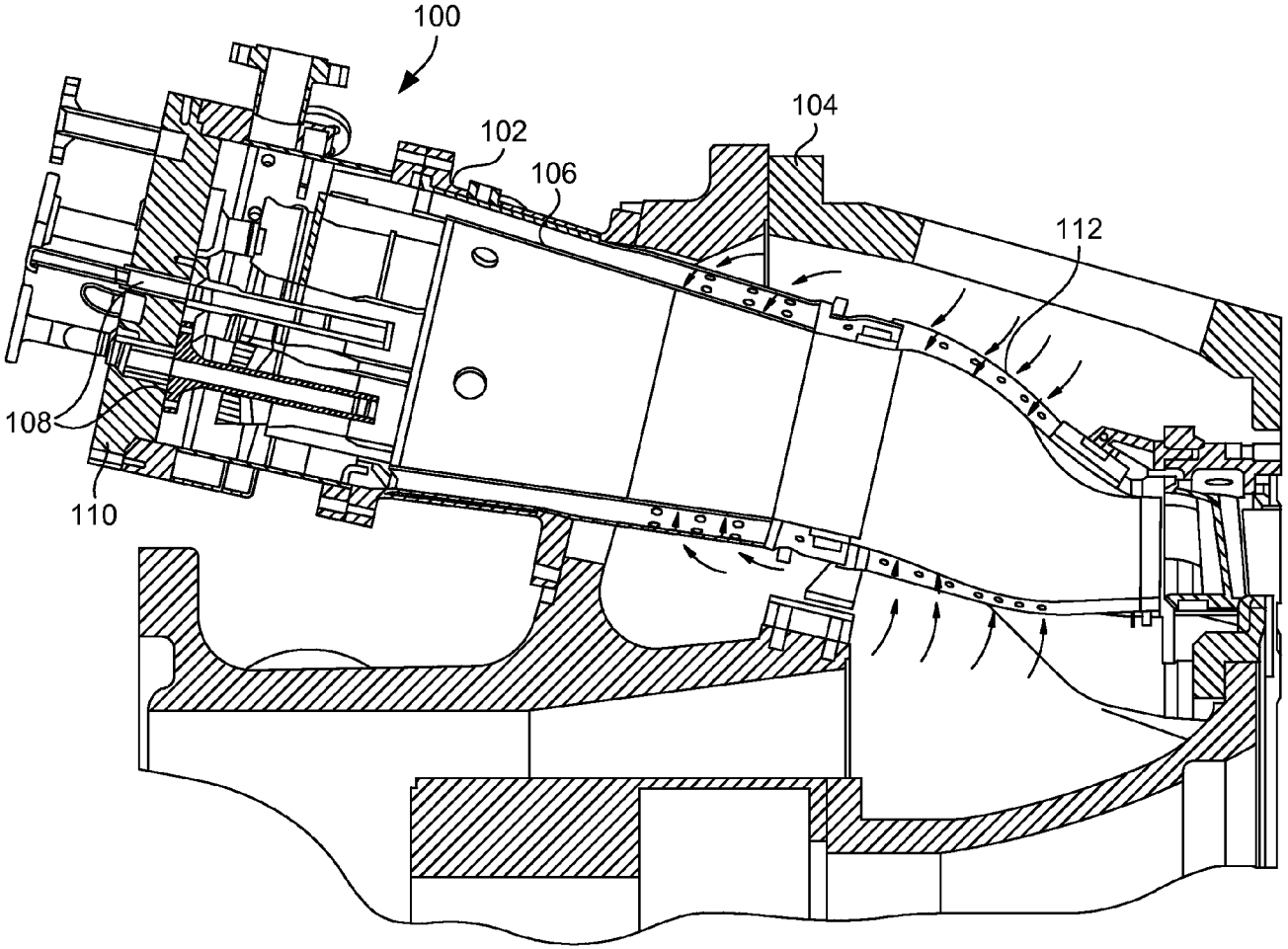
FIG. 1. PRIOR ART
FIG. 1 is a cross section view of a combustion system of a gas turbine engine of the prior art.

Referring initially to FIG. 1, a cross section view of a gas turbine combustion system 100 of the prior art is depicted. The typical gas turbine combustion system 100 includes a casing 102 coupled to a compressor discharge plenum 104. Contained within the casing 102 is a combustion liner 106 and one or more fuel injectors 108. The fuel injectors are typically secured to and are in fluid communication with a cover 110, which also provides an end to the casing 102. Fuel and compressed air from a compressor (not shown) mix and burn within the combustion liner 106 with the resulting hot combustion gases discharged through a duct 112. Air from compressor plenum 104 passes along an outer wall of the combustion liner 106 as the air is directed towards the forward end of the combustor.

Figure 2:
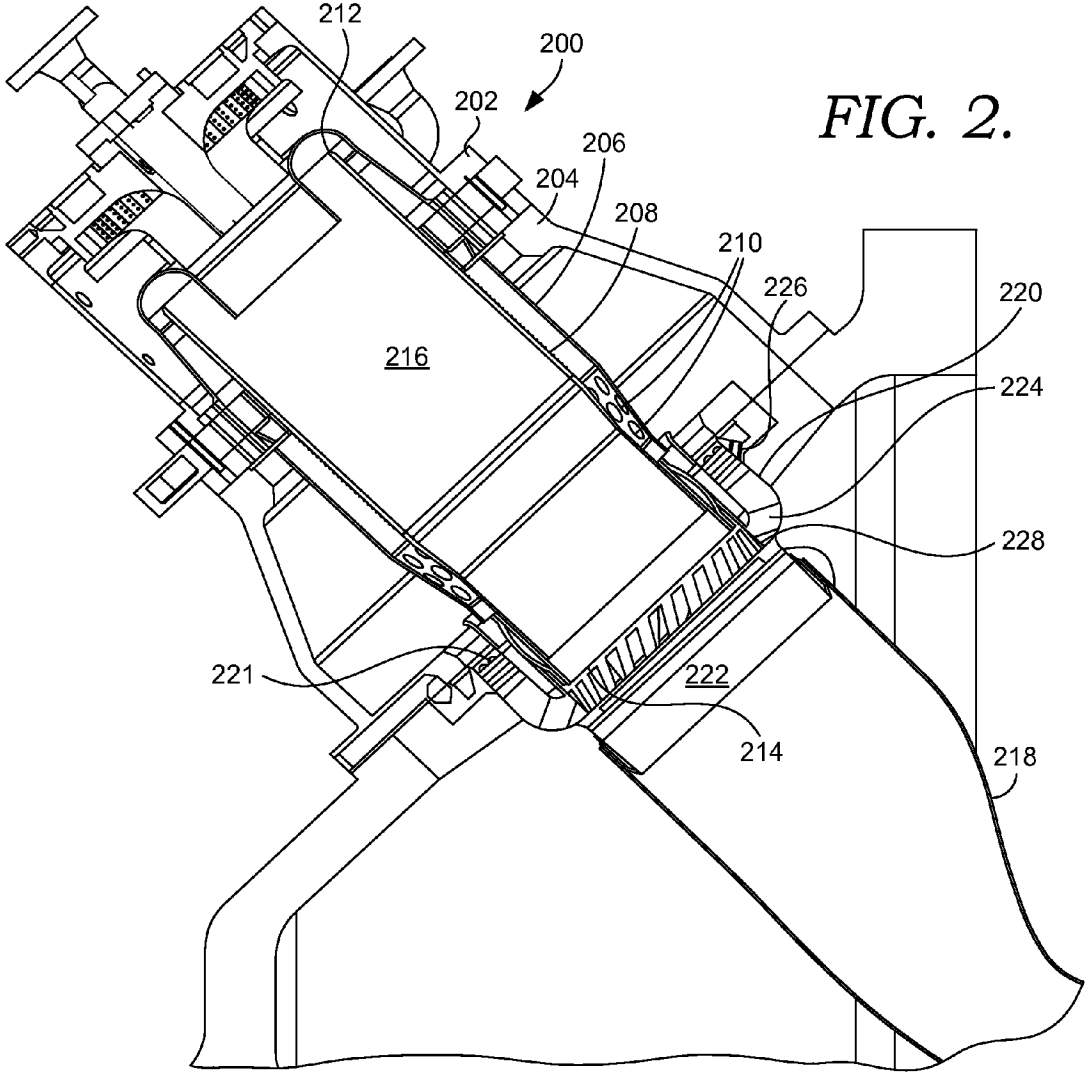
FIG. 2 is a cross section view of a combustion system of a gas turbine engine in accordance with an embodiment of the present invention.
Figure 3:
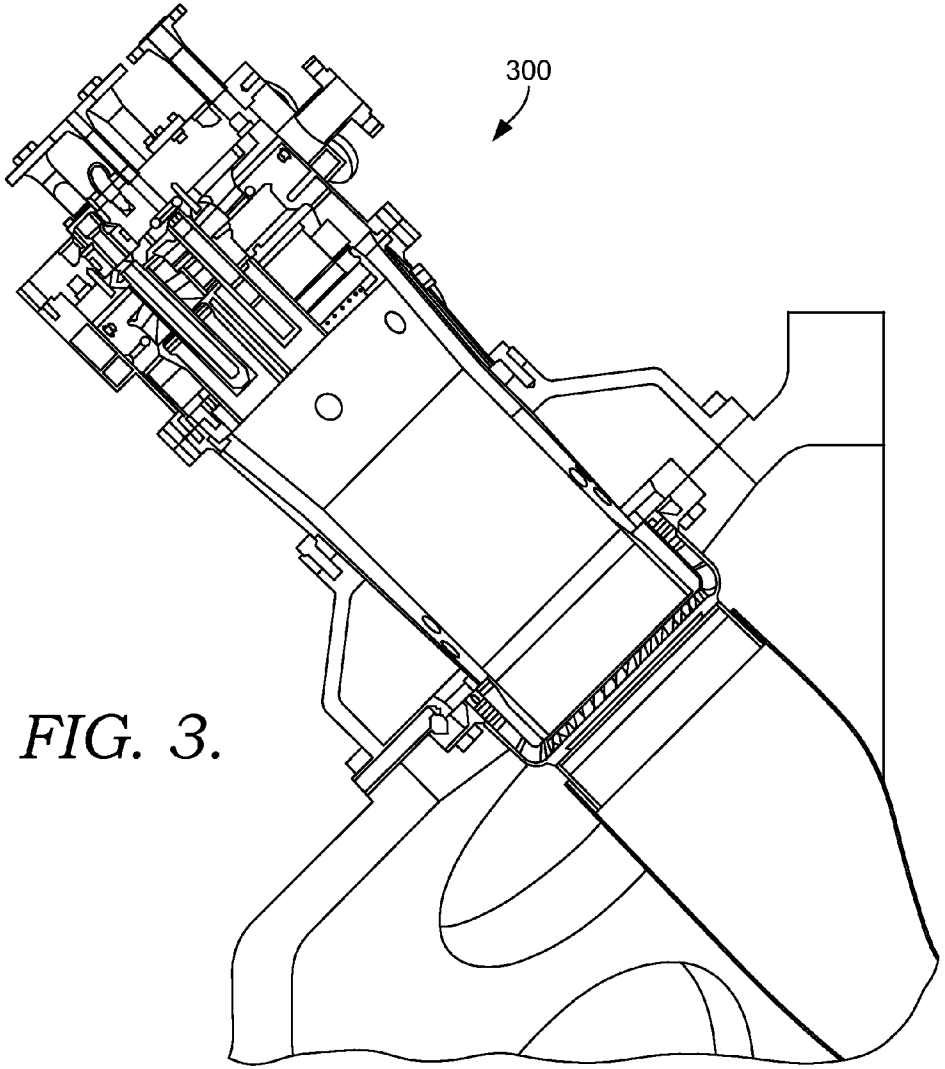
FIG. 3 is a cross section view of a combustion system in accordance with an alternate embodiment of the present invention.

The present invention is shown in detail in FIGS. 2-10 and can be applied to a variety of gas turbine combustion systems, as shown in FIGS. 2 and 3. The present invention provides an apparatus and method for providing high combustor efficiency and low nitrous oxide operation of a gas turbine combustor through an axially staged combustion system. Referring initially to FIG. 2, a gas turbine combustion system 200 in accordance with an embodiment of the present invention is shown in cross section. The combustion system 200 comprises an outer case 202 secured to a compressor discharge casing 204. Contained within the outer case 202 and discharge casing 204 is a flow sleeve 206 and a combustion liner 208. The flow sleeve 206 regulates the quantity of air provided for the combustion process as well as to straighten the flow of air passing along the combustion liner 208 to better direct the air for cooling of the combustion liner and for use in the combustion process. More specifically, the flow sleeve 206 regulates the quantity of air utilized through a series of metering holes 210 positioned about an aft end of the flow sleeve 206.

The combustion liner 208 has an inlet end 212, an opposing outlet end 214, and a first combustion chamber 216 positioned therebetween. The combustion liner 208 is in fluid communication with a transition duct 218, which receives the hot combustion gases from the combustion liner 208 and directs the gases into an inlet of a turbine (not shown).

Figure 4:
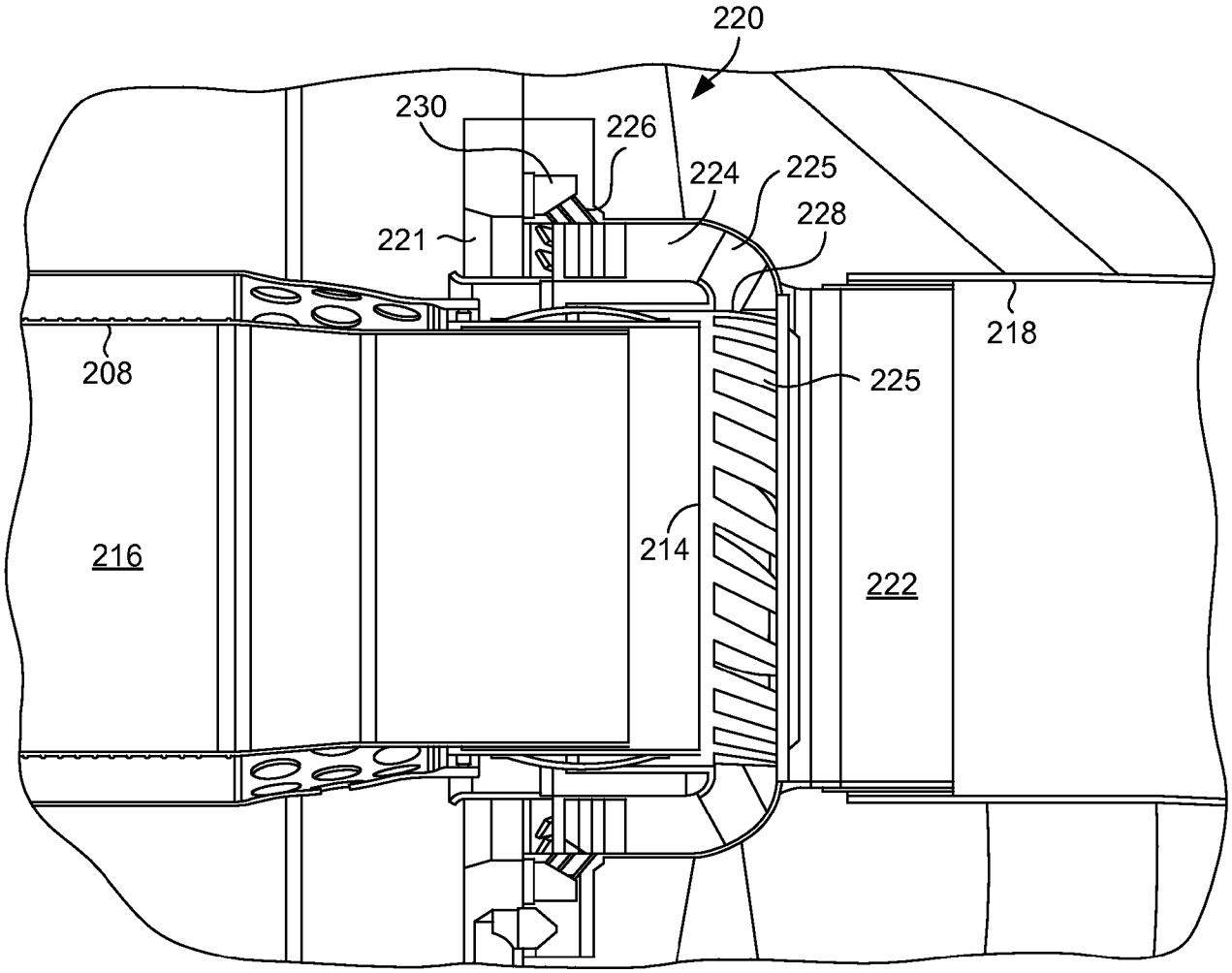
FIG. 4 is a detailed cross section view of a portion of the combustion system of FIG. 2 in accordance with an embodiment of the present invention.

As shown in FIG. 4, the outlet end 214 of the combustion liner 208 passes the exhaust of hot combustion gases to a premixer 220, which is positioned generally between the combustion liner 208 and the transition duct 218. The premixer 220 provides a homogeneously mixed flow of fuel and air to a second combustion stage 222 that is spaced axially downstream from the first combustion chamber 216, but upstream of the transition duct 218.

Figure 5:
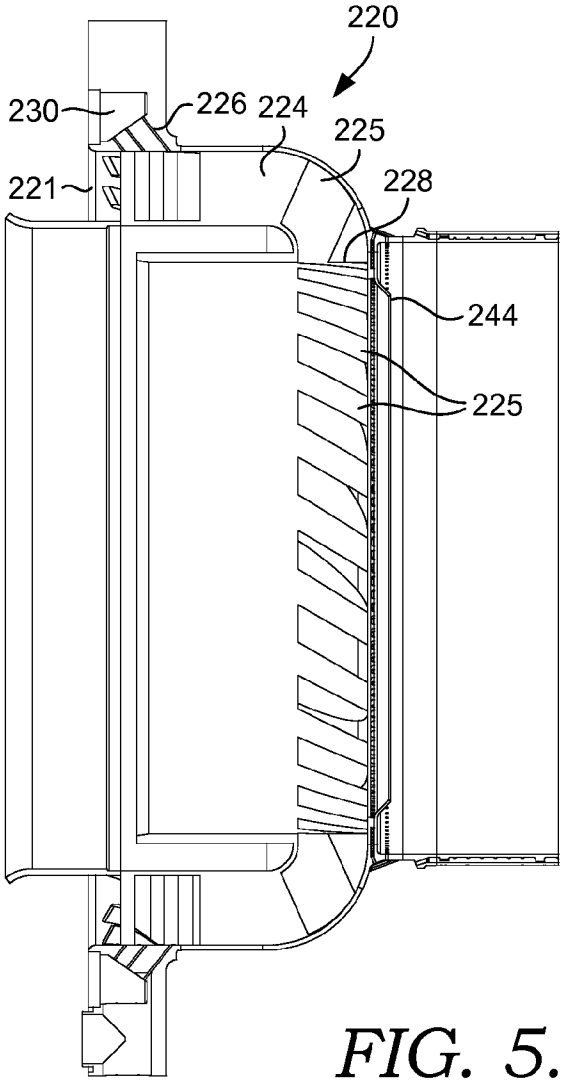
FIG. 5 is a partial cross section view of the premixer portion of the combustion system of FIG. 2 in accordance with an embodiment of the present invention.
Figure 6:
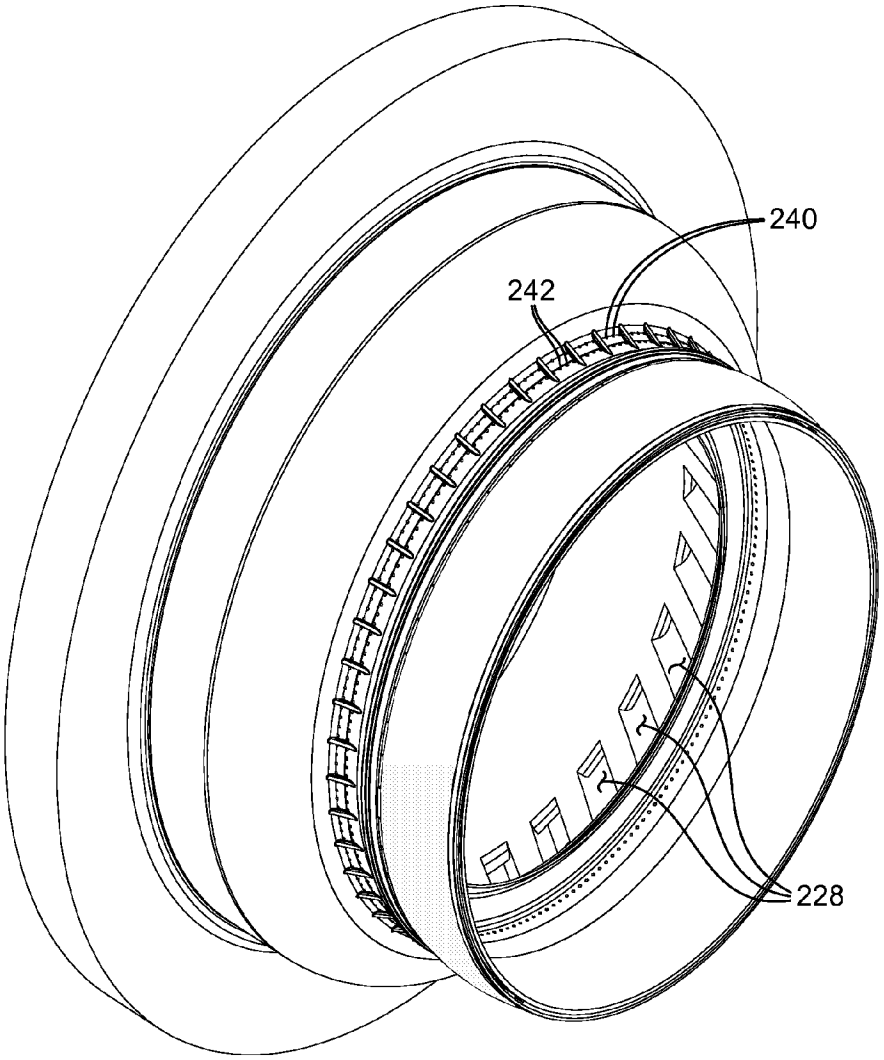
FIG. 6 is a perspective view of an aft portion of the combustion system of FIG. 2 in accordance with an embodiment of the present invention.
Figure 8:
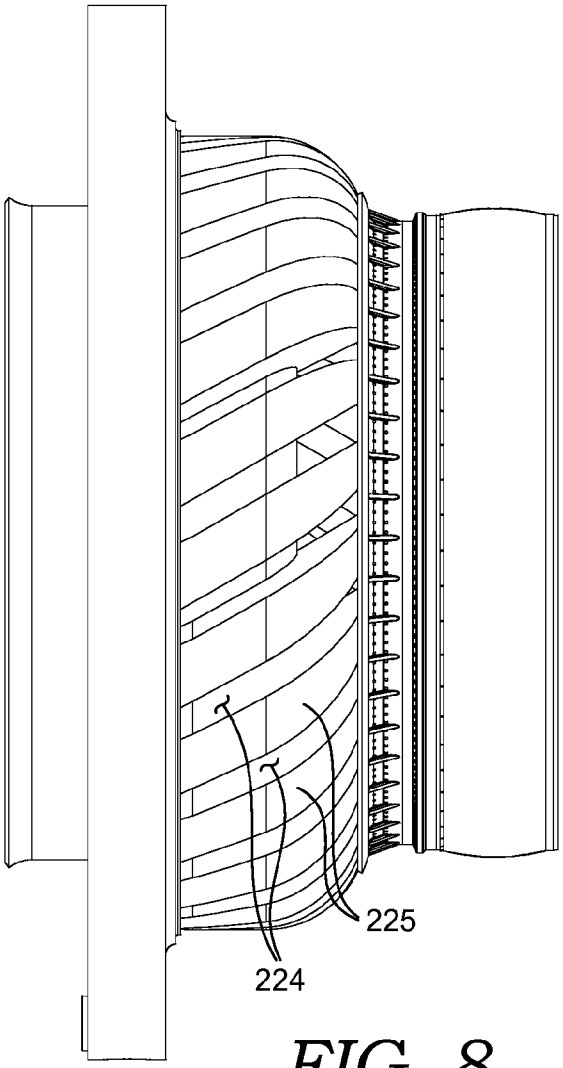
FIG. 8 is a side elevation view of the aft portion of the combustion system of FIG. 7 in accordance with an embodiment of the present invention.
Figure 9:
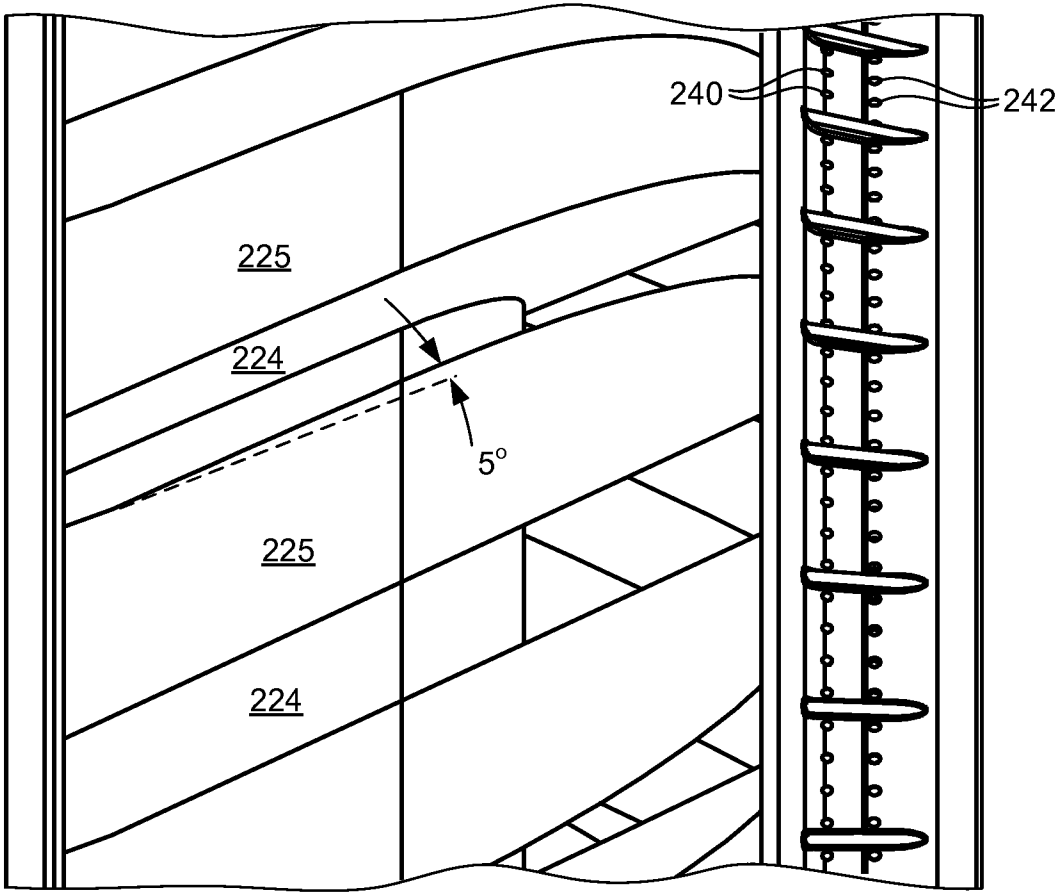
FIG. 9 is a detailed elevation view of a channel in the premixer in accordance with an embodiment of the present invention; and, FIG. 10 is a flow diagram outlining a process for providing low emissions for an axially staged combustion system in accordance with an embodiment of the present invention.
Figure 10:
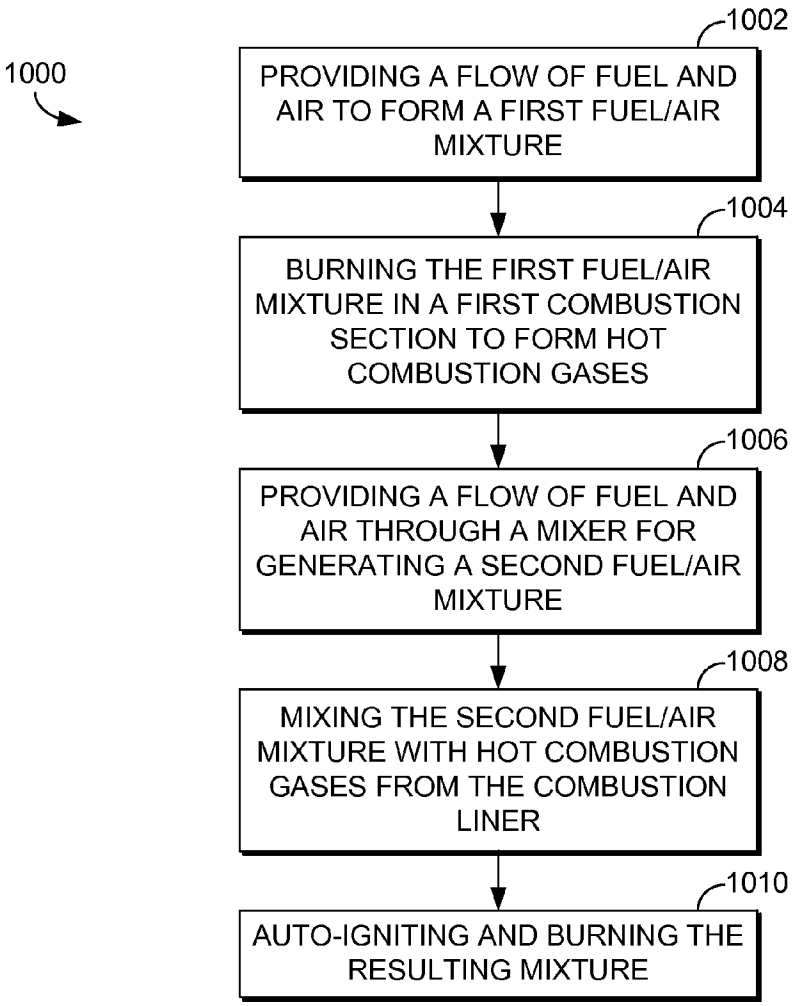

Referring now to FIGS. 4-6, the premixer 220 will be discussed in greater detail. The premixer 220 has an annular opening 221 through which compressed air enters and is directed into a plurality of channels 224, which are spaced a distance apart, as shown in FIGS. 5, 6 and 9, and formed between vanes 225. Referring to FIGS. 4 and 5, and as will be discussed below, the premixer 220 also has a plurality of fuel injectors 226 for directing fuel into one or more of the channels 224, where channels 224 are formed between vanes 225. For the embodiment shown in FIGS. 4, 5, 7, and 8, there are 24 equally spaced channels 224 in the premixer 220 with the channels 224 being oriented in both an axial and tangential direction to induce a swirl and enhance mixing of the air passing therethrough. However, it is to be understood that the exact size, shape, orientation, and spacing of the channels can vary depending on specific combustor requirements. For example, it is envisioned that the quantity of channels 224 could vary from approximately twelve channels to approximately 48 channels.

Figure 7:
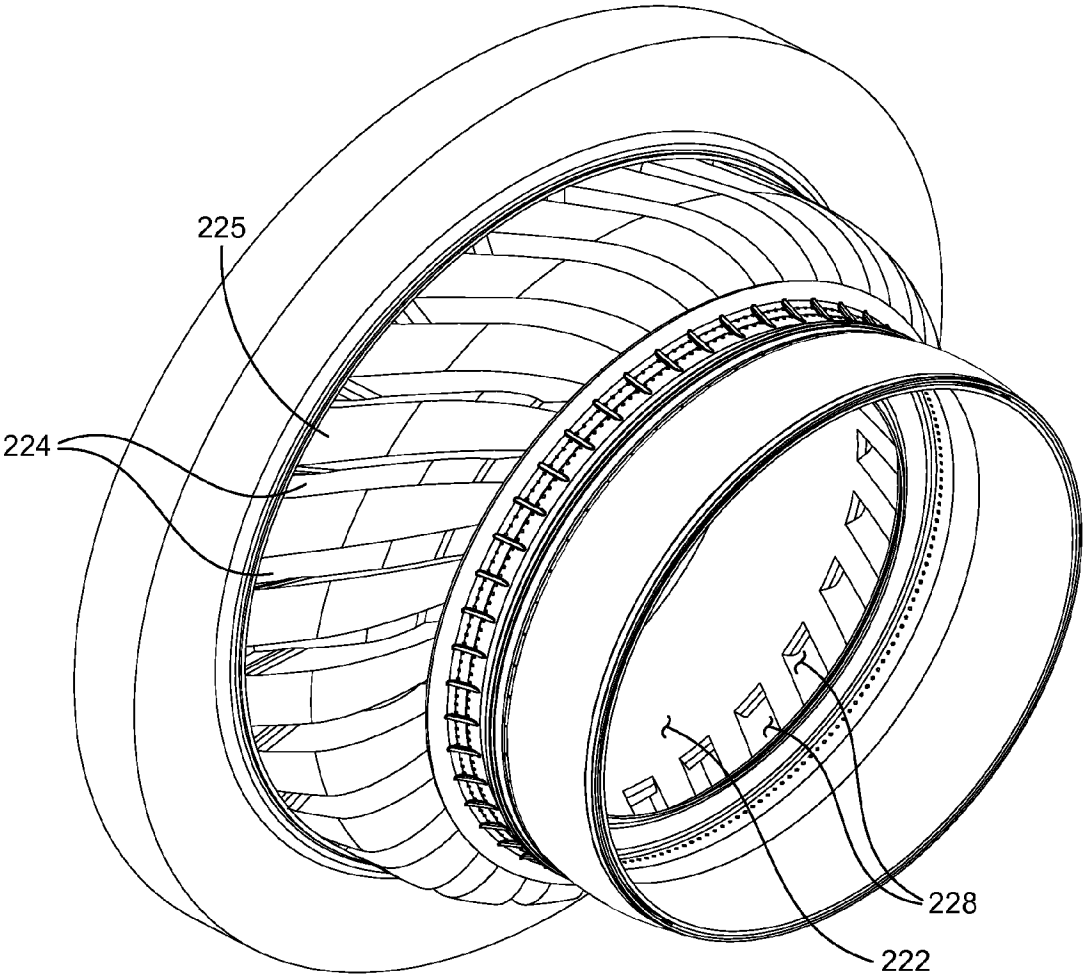
FIG. 7 is an alternate perspective view of the aft portion of the combustion system of FIG. 6 in accordance with an embodiment of the present invention.

The channels 224 are important to the overall effectiveness of the premixer 220 by providing axial, circumferential, and radial mixing. However, the channels 224 can vary in size and shape from a channel opening 226 to a channel outlet 228. That is, for the embodiment shown, the channel 224 has an axial, tangential and radial component, but the exact size, shape, and quantity of channels can vary. As shown in FIGS. 7-9, in which a portion of the premixer outer wall is removed for clarity, the channel 224 generally maintains a constant slot height, which for the embodiment shown, is approximately two inches. However, this slot height can vary in both height and taper for alternate embodiments of the present invention.

Channel 224 also has a slot length, which for the embodiment of FIG. 5, is the total length extending from annular opening 221 to outlet 228. As for the width of channel 224, the channel width can vary. In one embodiment, the channel 224 has a first slot width of approximately one inch, but then tapers to approximately 0.9 inches wide at a second slot width, which is located a short distance axially downstream of the fuel injectors 226. The channel 224 then tapers to a larger channel opening to provide a velocity of approximately 50 meters per second or greater at the channel outlet 228, or discharge plane, with the taper of the channel occurring at approximately a five degree angle. The five degree angle permits expansion of the fuel/air mixture while ensuring the flow within the channel 224 does not separate as separation of the flow can cause a flame to anchor in the premixer 220. That is, the effective throat of the channel 224 can taper, either in a width dimension, a height dimension or both, in order to accelerate flow starting at inlet 221 through a channel area reduction to prevent flashback. However, depending on operating requirements, it is possible that the channel 224 does not need to taper.

In the embodiment of the present invention shown in FIGS. 4-6, the channel 224 also has a bottom surface, which is generally flat or generally conical. However, as discussed above, the specific geometry of the channel 224 can vary depending on the desired performance for the premixer component. More specifically, because the premixer 220 is passing a fuel/air mixture into a second combustion stage 222, where, upon interaction of the fuel/air mixture with the hot combustion gases, auto-ignition occurs due to the high temperatures of the hot combustion gases. It is important that the channel has geometry such that the fuel/air mixture maintains a velocity of at least 50 meters per second in order to maintain sufficient margin to prevent a flashback from occurring. Depending on fuel composition, this value can be significantly higher.

As discussed above, the premixer 220 also includes a plurality of fuel injectors 226 for supplying fuel to an air stream to form the second fuel/air mixture. The fuel injectors 226 can be seen most clearly in FIGS. 4 and 5. An annular fuel manifold 230 is positioned radially outward of the channels 224 and contains a supply of fuel. Fuel injectors 226 are positioned to pass the fuel from the manifold 230 into one or more of the channels 224. The exact quantity, size, spacing, and injection angle of fuel injectors 226 relative to the channels 224 will vary depending on the crossflow through the channels 224 and penetration requirements for when the second fuel/air mixture enters the second combustion stage 222. For example, in the embodiment depicted in FIGS. 4-7, there are three fuel injectors 226 in the manifold 230 supplying fuel to each channel 224, with the fuel being injected at approximately a 30 degree surface angle. The fuel is injected at an angle in this embodiment to avoid separation and recirculation after the point of fuel injection, so as to avoid any possibility of flame holding. The fuel injectors 226 are also positioned so as to not be directly exposed to hot combustion gases from the combustion liner in order to protect the fuel injectors and fuel manifold from damage that could occur due to the hot temperatures of the combustion gases as well as damage from an auto-ignition and burning of fuel within the premixer 220.

The premixer 220 is positioned generally between the combustion liner 208 and transition duct 218. However, as shown in FIGS. 2 and 4, a portion of the premixer 220, is positioned radially outward of the outlet end 214 of the combustion liner 208. More specifically, the flow of the fuel and air through the channels 224 of the premixer 220, in addition to being imparted with at least a partial radial component due to the angles of the channels 224, is also directed from the premixer 220 radially inward into the second combustion stage 222. The forward and aft ends of the premixer 220 are positioned generally between the combustion liner 208 and the transition duct 218, such that the combustion liner 208 is secured to the forward end of the premixer 220 while the transition duct 218 is secured to the aft end of the premixer 220.

Referring now to FIG. 5, the premixer 220 may include additional flame stabilization features, such as a converging orifice plate 244 with a sudden expansion, aft of the channel opening to create a recirculation zone at the entrance of the second combustor.

The combustion system 200 also comprises one or more fuel injectors positioned to inject a flow of fuel to mix with air within the combustion liner 208. This first fuel/air mixture is ignited and burns in the first combustion chamber 216, with the hot combustion gases formed as a result of the burning being directed axially downstream towards the outlet end 214 of the combustion liner 208. A variety of fuel types can be burned in the combustion system 200, including, but not limited to gaseous fuel or liquid fuel.

In other embodiments of the present invention, it is envisioned that fuel injectors 226 may not be placed within every channel 224, but could be spaced in alternating channels or in another pre-determined pattern. Furthermore, alternate embodiments of the present invention may have a single or multiple fuel injectors 226 in their respective channel and the angle of fuel injection may also vary from the 30 degree angle of the embodiment shown in FIGS. 4 and 5.

In order to provide a combustion system capable of improved mixing and ensuring sufficient durability, it is necessary to configure the premixer 220 such that only the mixing of fuel and air occurs proximate the channel outlet 228 and there is no ignition. That is, ignition of the mixture from the premixer 220 should be restricted to the second combustion stage 222.

The present invention is also directed towards a method of providing low nitrous oxide and carbon monoxide operation for a gas turbine combustor that also provides increased turndown. The gas turbine combustor has a combustion liner with a first combustion chamber and a premixer is positioned proximate the outlet end of the combustion liner for providing a subsequent fuel/air mixture to the hot combustion gases from the first combustion chamber. The method 1000, which is outlined in FIG. 10, comprises providing a flow of fuel and air to form a first fuel/air mixture in a step 1002. Then, in a step 1004, the first fuel/air mixture is burned to form hot combustion gases in the combustion liner. In a step 1006, a flow of fuel and air is provided through the premixer for generating a second fuel/air mixture. This second fuel/air mixture is injected into a second combustion stage which is positioned proximate an inlet region of the transition duct. Then, in a step 1008, the second fuel/air mixture is mixed with the hot combustion gases from the combustion liner and this mixture is auto-ignited and burned in a step 1010.

The present invention is not limited to use with a type of gas turbine combustor depicted in FIG. 2, but instead can be applied to a variety of combustion systems. For example, the present invention can be applied to a variety of commercially-available combustion systems, including, but not limited to, a single axially stage combustor 300, such as a Dry-Low NOx 2.0/2.6 combustion system on the Frame 7FA gas turbine engine produced by the General Electric Company and as depicted in FIG. 3. As discussed above, the exact size and shape of the premixer portion of the present invention will vary depending on the type of upstream combustion system.

The result of the process described herein uses the premixer to create an axially staged combustor with more complete burning of the fuel particles, leading to low Nox and CO emissions. Furthermore, the arrangement provides for increased turndown, allowing the engine to operate at lower load settings.

Due to the proximity of the premixer 220 to the combustion liner 208 and the associated need for the components to thermally expand and contract together, it is preferable that the premixer 220 be fabricated from materials capable of withstanding the operating temperatures of the combustion liner 208. Therefore, such acceptable materials for the premixer 220 can include a nickel-based alloy. As shown in FIGS. 2 and 4, a portion of the premixer 220 is positioned axially between the combustion liner 208 and the transition duct 218. Therefore, in addition to the premixer 220 being fabricated from high temperature capable materials, depending on the operating conditions of the combustion system, the inner surface of the discharge end of the premixer 220 may also be coated with a thermal barrier coating for providing additional capability against the high operating temperatures. The coating applied to a portion of the premixer, would be comparable to that also applied to the adjacent combustion liner and transition duct.

The present invention has been described in relation to particular embodiments, which are intended in all respects to be illustrative rather than restrictive. Alternative embodiments and required operations, such as machining of shroud faces other than the hardface surfaces and operation-induced wear of the hardfaces, will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. An axially staged combustion system comprising:

a combustion liner having an inlet end, an outlet end, and a first combustion chamber positioned therebetween;

a transition duct in fluid communication with the combustion liner and positioned downstream, in an axial direction, from the combustion liner; and a premixer positioned generally between the combustion liner and the transition duct in the axial direction for providing a homogeneously mixed flow of fuel and air to a second combustion stage spaced downstream, in the axial direction, from the first combustion chamber, the premixer comprising:

an annular opening positioned radially outward of an aft end of the combustion liner and configured to receive compressed air;

a plurality of channels spaced a distance apart and positioned downstream, in the axial direction, from the annular openino, wherein the annular opening is configured to direct the compressed air into the pluralit of channels, and wherein the pluralit of channels is configured to direct the compressed air downstream, in the axial direction, to the second combustion stage; and one or more fuel injectors positioned within one or more of the channels for injecting a flow of fuel into the channels.

2. The axially staged combustion system of claim 1, wherein the transition duct directs a flow of hot combustion gases from the combustion liner and premixer into a turbine inlet.

3. The axially staged combustion system of claim 1, wherein the premixer imparts at least a partial radial component to the fuel and the compressed air as a result of the shape and orientation of the channels of the premixer.

4. The axially staged combustion system of claim 1 further comprising an annular fuel manifold positioned radially outward of the plurality of channels, wherein the one or more fuel injectors are configured to pass the flow of fuel from the annular fuel manifold into the one or more channels.

5. The axially staged combustion systemof claim 1 further comprising an orifice plate aft of a channel opening.

6. The axially staged combustion system of claim 1, wherein the plurality of channels taper in width or height from a channel opening to a channel outlet.

7. An axially staged combustion system comprising:

a combustion finer having an inlet end, an outlet end, and a first combustion chamber positioned therebetween;

a transition duct in fluid communication with the combustion liner;

a premixer positioned generally between the combustion liner and the transition duct for providing a homogeneously mixed flow of fuel and air to a second combustion stage spaced axially downstream from the first combustion chamber, the premixer comprising:

a plurality of channels spaced a distance apart;

one or more fuel injectors positioned within one or more of the channels for injecting a flow of fuel into the channels; and an orifice plate aft of a channel opening.

8. The axially staged combustion system of claim 7, wherein the transition duct directs a flow of hot combustion gases from the combustion liner and premixer into a turbine inlet.

9. The axially staged combustion system of claim 7, wherein the premixer imparts at least a partial radial component to the fuel and air as a result of the shape and orientation of the channels of the premixer.

10. The axially staged combustion system of claim 7, wherein a portion of the premixer is positioned radially out ar d of an aft end of the combustion liner.

11. The axially staged combustion system of claim 7 further comprising an annular fuel manifold positioned radially outward of the plurality of channels, wherein the one or more fuel injectors are configured to pass the flow of fuel from the annular fuel manifold into the one or more channels.

12. The axially staged combustion system of claim 7, wherein the plurality of channels taper in width or height from a channel opening to a channel outlet.

13. The axially staged combustion system of claim 7, wherein the orifice plate is configured to induce a sudden expansion of the homogeneously mixed flow of fuel and air aft of the channel opening.

14. The axially staged combustion system of claim 7, wherein the orifice plate is configured to create a recirculation zone at an entrance of the second combustion stage.

* * * * *